United States Patent [19]

Ziegler et al.

[11] 4,366,981

[45] Jan. 4, 1983

[54] STANDING WORK SEAT

[75] Inventors: Horst Ziegler, Albbruck; Dagobert Bögle, Laufenburg, both of Fed. Rep. of Germany

[73] Assignee: Christof Stoll GmbH & Co. KG, Waldshut-Tiengen, Fed. Rep. of Germany

[21] Appl. No.: 135,185

[22] Filed: Mar. 28, 1980

[30] Foreign Application Priority Data

Mar. 29, 1979 [DE] Fed. Rep. of Germany ..... 2912398

[51] Int. Cl.[3] ..... A61G 15/00

[52] U.S. Cl. ..... 297/328; 248/188.9; 297/4; 297/195; 297/349; 297/DIG. 2

[58] Field of Search ..... 297/328, 349, 4, 195, 297/DIG. 2, 300, 301, 302, 156; 108/15 D; 248/188.9

[56] References Cited

U.S. PATENT DOCUMENTS

| | | | |
|---|---|---|---|
| 1,973,226 | 9/1934 | Rose et al. | 248/188.9 X |
| 2,177,387 | 10/1939 | Greitzer | 108/150 X |
| 2,850,077 | 9/1958 | Dawson | 297/328 X |
| 3,341,251 | 9/1967 | Costin | 297/DIG. 2 |
| 3,441,315 | 4/1969 | Paes et al. | 297/458 |
| 3,833,259 | 9/1974 | Pershing | 297/DIG. 1 |
| 3,884,525 | 5/1975 | Mesinger | 297/DIG. 2 |
| 4,148,523 | 4/1979 | Brand et al. | 297/453 |
| 4,183,579 | 1/1980 | Gonzalez y. Rojas | 297/195 |
| 4,198,094 | 5/1980 | Bjerknes | 297/328 |
| 4,234,152 | 11/1980 | Browse | 297/349 X |

FOREIGN PATENT DOCUMENTS

| | | | |
|---|---|---|---|
| 2421896 | 12/1975 | Fed. Rep. of Germany . | |
| 2618292 | 11/1977 | Fed. Rep. of Germany . | |
| 2357538 | 6/1978 | Fed. Rep. of Germany . | |
| 1042842 | 1/1953 | France | 297/4 |
| 1333156 | 6/1963 | France . | |
| 1480037 | 3/1967 | France . | |

*Primary Examiner*—James T. McCall

*Attorney, Agent, or Firm*—Oblon, Fisher, Spivak, McClelland & Maier

[57] ABSTRACT

Disclosed is a standing work seat in which the support column and the base are rigidly attached together, the support column is inherently rotatable, the seat is inclinable in the seat direction. The seat exhibits a rear edge drawn up to the user's iliac crest, a rounded front edge and a slip-inhibiting configuration of the seat surface. The standing work seat permits optimum absorption of a user's body load in confined work stations.

8 Claims, 3 Drawing Figures

STANDING WORK SEAT

BACKGROUND OF THE INVENTION

1. Field of the Invention

The invention relates to a portable standing work seat with a substantially circular flatly tapered non-slip base, a support column and a dish-shaped seat with raised rear edge and a declining front edge, the seat being mounted at the top end of the support column.

2. Description of the Prior Art

Standing work seats are extremely useful, particularly where the use of a customary seat unit with thigh supports oriented substantially horizontally is impossible at a work station. For example, when a particular work height or a particular reaching distance are necessary for a machine which is to be operated, or when the free space for the operator's thighs, knees or feet are constricted by machine parts.

Standing work seats used at such work stations produce a physical relief for the worker with the result of increased concentration upon the work to be performed and avoidance of muscular cramps and fatigue. Such standing work seats assume a considerable part of the load of the user's upper torso and permit a considerable extension of the legs so that the latter need only perform a bracing and stabilizing function and the leg muscles can be largely relaxed. Furthermore, they permit the worker to alternate between standing and sitting postures.

A standing work seat of the above type is known, e.g., from DE-OS No. 2642 112. Disadvantages of the known standing work seat consist, inter alia, in the fact that the support column can execute inclinations with reference to the base, and that the seat is attached rigidly to the support column. Although the inclinability of the support column widens a user's range of reach, nevertheless the seat which permits inclination promotes sliding of the user, and the user is required to perform intercepting movements of his legs in order to avoid overturning. This prevents the optimum relaxation of the user with regard to the seat and his exclusive concentration upon the work is disturbed. Furthermore, due to the rigid non-rotatable fastening of the seat to the support column, the mounting and dismounting from the same is made difficult where knee space is restricted. The base consists of cast aluminium and therefore renders the standing work seat not only awkwardly heavy, but also costly and expensive of material.

A standing work seat is known from DE-PS No. 2618 292 and DE-OS No. 2641 242, wherein a collapsible tubular frame assumes a bracing on the floor and a small seat surface is vertically adjustably positioned at the top end of a tubular stirrup. The particular disadvantage of this solution is that the front tubular stirrup impairs the freedom of movement of the legs and feet and constitutes a stumbling hazard. Further, the range of reach is restricted because the seat is not rotatable.

It is a common disadvantage of both the known standing work seats that the seat surfaces of the seats do not take into consideration the physiological requirements of a user's buttocks and thighs, so that e.g., disproportionately high specific pressures are applied to highly sensitive parts of the body. These are not prevented even by the upholstery provided, because the seats have to be constructed of integral foam to withstand rough workshop conditions and are therefore relatively hard.

SUMMARY OF THE INVENTION

It is the object of the present invention to overcome the above deficiencies and to produce an ergonomically and physiologically advantageous standing work seat which is relatively inexpensive to manufacture and which can be made with a small material outlay, because with devices used in the field of production, the price is frequently the deciding factor as to the purchase of a work aid, even when other advantages of the aid are evident.

The standing work seat according to the present invention particularly exhibits the advantages that it possesses a robustness appropriate to rough workshop conditions, is handy and light to transport, is stumble-proof, and permits a great freedom for the feet and a wide range of reach, but can nevertheless also absorb tangential forces exerted by the user, optimises the pressure distribution of the buttocks and the support of the user's pelvis, prevents the user from slipping off and prevents kyphosis of the spinal column. Yet it can nevertheless be produced at a favorable price and with economy of material.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
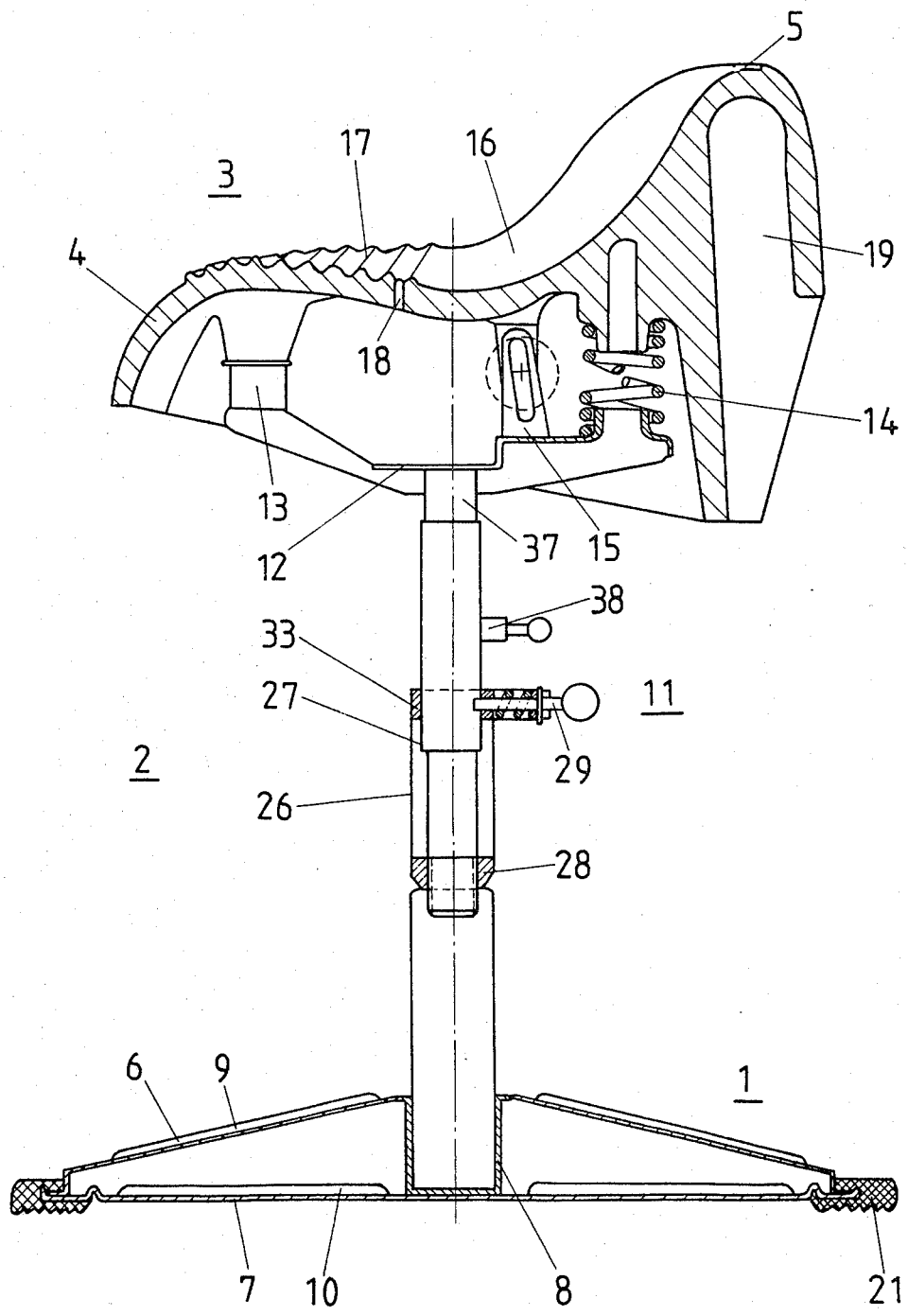
FIG. 1 shows a side elevation in section of the standing work seat according to the invention.

The standing work seat illustrated in FIG. 1 exhibits an extremely flatly tapered, light and nevertheless stable circular base 1. This comprises a dish-shaped top plate 6 and a plain bottom plate 7, which are joined firmly together directly at their outer edge and through the intermediary of the support ring 8 in the center. The connection is preferably established by spot welding. As may be seen, a triangular configuration is produced in cross-section, in which the flexural moments occurring are converted into pressure and tensile forces. It is therefore possible to use inexpensive thin sheet steel which may already be provided with a surface protection, e.g., galvanised, for corrosion resistance, so that no subsequent treatment is required. The necessary buckling strength of the plates is obtained by beads 9 and 10.

An outer encircling profile ring 21 of preferably elastic material, e.g., rubber or soft PVC, continuously welded, produces a slip-proof and gentle floor contact. The profile ring 21 may be fixed to the base of a step-shaped shoulder of the top plate 6, or by an annular bead in the bottom plate 7, into which a corresponding lip of the profile ring 21 engages. This is important so that the chair can be slid without the ring becoming detached.

The tubular support column 2 is rigidly attached to the base 1. It comprises a bottom tube 26, a top tube 27, and a spindle tube 37. The bottom tube 26 is frictionally or positively attached to the support ring 8. The bottom tube 26 embraces the top tube 27, which in turn surrounds the spindle tube 37. Spindle tube 37 and top tube 27 are rotatably mounted on the support ring 28 and passed through the chair column guide 33. The spindle tube 37 is axially slidable in the top tube 27 when the locking bolt 38 is released, so that the height of the seat can be adjusted. This mechanism is known and need not therefore be further described.

A rotational locking device 11 is provided at the lower end of the bottom tube 26. It exhibits an actuating knob 22 with a pin 29 which can engage a hole 30 (FIG. 3) in the top tube 27. The pin 29 can be fixed both in the retracted and in the engaged position. With the pin 29 retracted the column 2 is freely rotatable about its longitudinal axis, otherwise the column 2 is locked against rotation.

A seat bracket plate 12 is attached to the upper end of the spindle tube 37 which is guided in the top tube 27. It carries the seat 3 having the seat surface 16. In the illustrated example the seat 3 is suspended in front at two articulation points 13, one of which is visible in FIG. 1. Either conventional hinges, or, as shown, conventional commercial metal/rubber elements, the elasticity of which is sufficient to cover an overall angle of inclination of the seat 3 of approx. 15°, may be used in the articulation points 13. At the rear the seat 3 is braced by a spring 14 located in the plane of symmetry of the seat 3, which is retained in a non-slip position on suitably constructed projections of the seat bracket plate 12 and of the seat 3.

Figure 2:
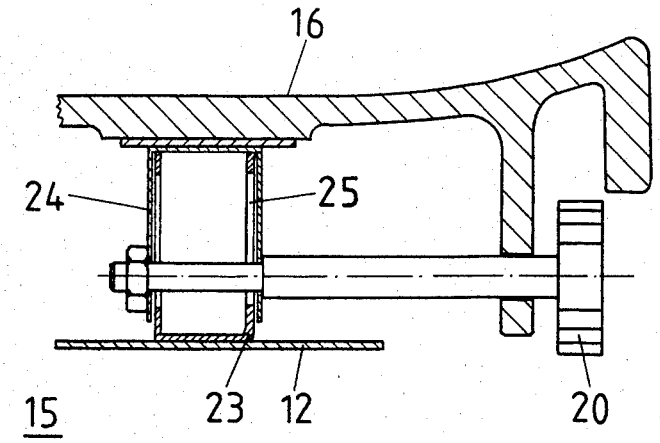
FIG. 2 shows in section the rear elevation of part of the seat from FIG. 1 section.

The inclination of seat 3 can be adjusted infinitely by the inclination adjustment device 15 illustrated in detail in FIG. 2, which is lockable and releasable by clamp fit through the actuating knob 20.

The seat surface 16 of the seat 3 is fundamentally of a dish-shaped configuration, but modified so that an optimum distribution of pressures to the user's buttocks and thighs, and a minimum danger of slipping, are obtrained; the rear edge 5 of the seat 3 is drawn up approximately to the iliac crest of an average user, the front edge 4 is rounded with a radius of 60 mm to 100 mm, preferably approx. 80 mm, the side edges are drawn up slightly in the buttocks region, a central bead is provided in the center between the user's thighs, and the surface exhibits a corrugation 17. Communicating holes 18 provide a ventilation of the space between buttocks and seat surface 16.

A handle cavity 19 is provided at the rear of the seat 3, by means of which the location of the standing work seat can be changed in a simple manner.

The rigid base 1 of the standing work seat illustrated and the support column 2 fixed rigidly therein and the seat 3 fixed rigidly on the latter give the user stable support. When the column 3 is adjusted for roatation, the user had the possibility of appropriate upper torso movement in the case of a lateral supply and discharge of material. If the column 2 is locked by the device 11, then the user can absorb greater tangential forces through the seat without having to intercept them with the feet. In the case of confined knee room the seat 3 may be rotated out of the work direction for the purpose of mounting or dismounting.

By virtue of its infinite inclinability in the longitudinal or seat direction, the seat 3 is optimally adaptable to the relevant work situation as well as the constitution and physical size of the user. If the inclination adjustment device 15 is released, then dynamic sitting with a changing seat inclination is possible, while the spring 14 compensates the proportional weight of the upper part of the user's body. On the other hand the spring 14 also acts as a recoil spring, i.e., the desired seat inclination is found by the user pressing the seat 3 into the desired position with his buttocks and then locking the inclination adjustment device 15.

The described particular configuration of the seat surface 16 of the seat 3 produces the effect that the major part of the forces generated by the load of the remainder of the body is introduced into the seat surface 16 in the region of the ischial protuberances, but the other, more pressure-sensitive, portions of the buttocks and of the thighs are nevertheless also suitably supported. The supporting of the user's pelvis prevents any disadvantageous kyphosis of the spinal column, particularly in the lumbar vertebra region. The corrugation 17 and the central bead prevent the user from slipping off even from a seat inclined steeply forwards, whereas the rounding of the front edge 4 produces a minimum pressure loading and gradual initiation of pressure to the thighs.

The lateral and rear edge of the seat surface 16 merges into an encircling wall extending substantially vertically downwards. Due to its web height, this wall produces a high rigidity of the seat 3, and furthermore makes the seat appear self-contained. It also acts as a safety cover for the actuating knob 20 (FIG. 2) set in at the side, and for the inclination adjustment device 15. This cover is important under rough workshop conditions. The wall permits the integral inclusion of the handle cavity 19 at the rear of the seat.

The inclination adjustment device 15 is shown in greater detail in FIG. 2. It comprises two parallel oriented pairs of metal tongues 23, 24 positioned at right angles to the axis of rotation and located in the axis of symmetry of the seat 3. The lower pair of metal tongues 23 is firmly attached to the seat bracket plate 12 and extends from the bottom upwards, the other pair is fixed firmly below the seat surface 16 and extends from the top downwards. One pair of metal tongues—the lower one in the example illustrated—has pairs of slots, the other a round passage hole. By appropriate intermediate pieces and a rotary rod which has a screw-thread at its end, it is possible to mutually clamp the tongues. The clamping force may be relatively weak, since this arrangement has the function of a multiple-disc clutch. The required clamping torque is exerted, or the firm clamping released, through a firmly attached actuating knob 20 in the form of a hand wheel at the end of the screwthreaded rod.

The hand wheel 20 is set into the seat 3 at the side, i.e., in the most favorable region for access.

Figure 3:
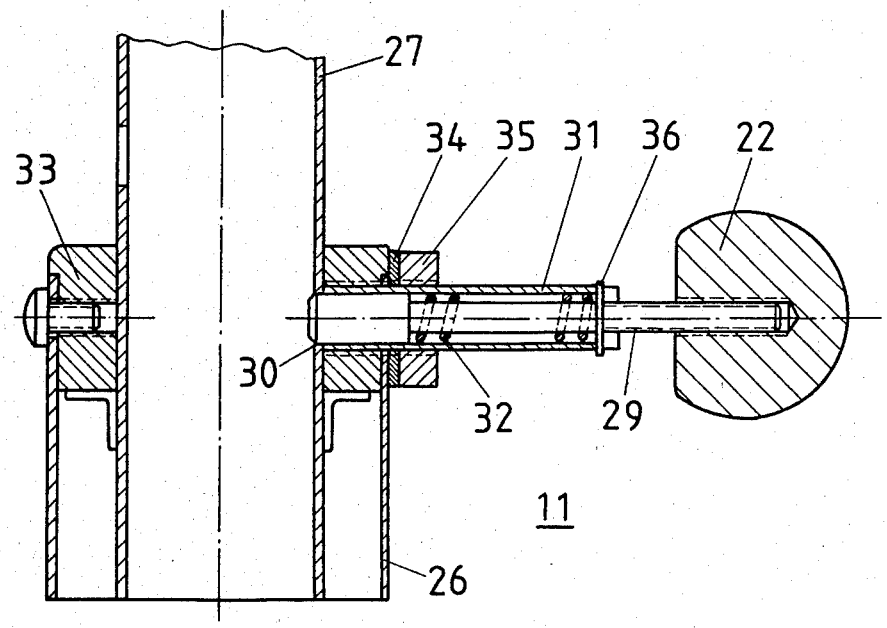
FIG. 3 shows a detail of the rotational locking device of the support column indicated in FIG. 1.

The rotational locking device 11 is illustrated in greater detail in FIG. 3. It comprises a sleeve 31 which is flanged at the end and thus serves as an abutment for an actuating spring 32. The sleeve 31 is provided with a male screwthread and is screwed into the associated female screwthread of the chair column guide 33. The position and firm fit of the sleeve 31 are ensured by a form-locking washer 34 and a check nut 35. In the sleeve 31 there is mounted with axial sliding mobility a shouldered pin 29, the free end of which protrudes out of the end orifice of the sleeve 31 and which carries an actuating knob 22 at that end. The shoulder of the pin 29 serves as a second abutment for the compression spring 32. A transversely oriented slot at the free end of the sleeve 31 accommodates a stop pin 36, which is in turn firmly attached to the free end of the pin 29. When the pin 36 reaches the bottom of the slot, it forms the stop of the locking pin 29 in the locked position. Withdrawn from the slot and rotated 90°, the locking pin 29 is permanently unlocked. If the locking pin 29 is only pulled, but the pin 36 is left in the slot, then the seat 3 can be rotated sideways. When it is pivoted back into the old position, the locking pin 29 re-engages automatically.

Top plate 6, bottom plate 7 and support ring 8 of the base 1 are preferably produced of sheet steel or aluminium. All three parts may be fabricated from round discs which are easy to manufacture. The top and bottom plates are simple stampings. Spot flanges for inexpensive spot welding are provided at the joint positions.

The seat bracket plate 12 is also preferably made from sheet steel or sheet aluminium, while the lower pair of metal tongues 23 is integrally formed.

The seat 3, including the handle cavity 19, is also designed so that it consists of a single part and can be produced by a single production tool, preferably from plastics material and by injection moulding methods. In order to obtain adequate self-rigidity by appropriately dimensioned wall thicknesses, plastics material having a cellular structure such as TSG (die cast plastic containing a foaming agent) or RSG (reaction die cast plastic) may be used advantageously.

The seat 3 may also consist of two parts, a load bearing core and an upholstery layer surrounding the same. Said upholstery layer may preferably consist of so-called PUR (polyurethane) integral foam. In this case a compact outer skin and a cellular core layer is generated. The load bearing part may be integrally expanded.

The base 1 can be simplified by omitting the support ring 7 in the center and replacing it with the upright tube 2. This solution may be disadvantageous if it is desired to combine bases with upright tubes of different lengths in order to simplify stocking.

Lastly, the seat bracket plate 12 could also be arranged rotatably on the top tube 27 if it is proposed to make the support column 2 of non-rotatable construction.

The possibility of being able to tilt the seat 3 above an axis in the seat direction is expressly not desired, because this again communicates to the user an impression of an unstable sitting situation, which causes him to make undesirable intercepting movements of the legs.

Obviously, numerous modifications and variations of the present invention are possible in light of the above teachings. It is therefore to be understood that within the scope of the appended claims, the invention may be practiced otherwise than as specifically described herein.

We claim:

1. A portable standing work seat with a substantially flatly tapered non-slip base, a vertically adjustable support column on said base and a dish-shaped seat with an updrawn rear edge and forwardly declining front edge, said seat being mounted at the top of said support column, wherein:

said support column and said base are rigidly fixed perpendicular to one another;

said seat is rotatable about the longitudinal axis of said support column for providing angular adjustment;

a rotational locking device is associated with said support column for preventing the rotation of said seat about said longitudinal axis of said support column;

a seat bracket plate is fixed to said support column, said bracket plate being articulated to the front part of said seat by at least one articulation point;

an inclination adjustment device is connected between said seat bracket plate and the rear part of said seat for adjusting the inclination of said seat about said at least one articulation point;

the seat surface of said seat has raised side edges and a raised central bead extending in a first direction connecting the front and reat ends of said seat;

said rear edge of said seat is elevated approximately to the iliac crest of an average user;

said front edge of said seat is rounded; and the surface of said seat exhibits a configuration which inhibits the forward slipping of a user.

2. The standing work seat of claim 1 wherein said base comprises an annular top plate and an annular bottom plate, and a support ring is arranged in the center of said base and receives the support column, wherein said top and bottom plates are directly joined together at their outer edge and through the intermediary of the support ring at their centers whereby a triangular form is produced in cross-section, and wherein said top and bottom plates include beads providing increased buckling strength.

3. A standing work seat according to claim 1 on which at least one spring is arranged which supports the rear portion of said seat, and wherein an inclination adjustment device is provided between the rear portion of the seat and the seat bracket plate, said inclination adjustment device permitting an infinite adjustment of the seat inclination by a clamp fit.

4. The standing work seat of claim 1, wherein said seat surface exhibits a corrugation oriented transversely to said first direction, and communicating bores extending from the top side of said seat to the bottom side of the seat, and the front edge of the seat is rounded with a radius of 60 to 100 mm.

5. The standing work seat of claim 1 wherein said seat exhibits an encircling wall extending from the edge of said seat surface substantially vertically downwards, said wall forming a handle cavity on the rear side of said seat and a cavity for an actuating knob of said inclination adjustment device of the seat at the side of said seat.

6. The standing work seat of claims 2 or 3 wherein said seat is an intergral plastic injection moulding and said base consists of corrosion-protected sheet steel and wherein said base exhibits at its outer edge an encircling profile ring of elastic material which is fixed form-lockingly in said sheet metal.

7. The standing work seat of claim 5 wherein said seat comprises a core and an envelope of respectively different plastic structures, said core being of cellular load bearing plastic and said envelope being of integrally foamed upholstering construction.

8. The standing work seat of claim 1 wherein an actuating knob for said rotational locking device is provided on said support column, said actuating knob being fixable in two positions, wherein the said support column is locked against rotatability in one said position and is freely rotatable in the other said position.

* * * * *